US005965198A

United States Patent [19]

Plusquellec et al.

[11] Patent Number: 5,965,198

[45] Date of Patent: Oct. 12, 1999

[54] PROCESS FOR THE MANUFACTURE OF A PLASTIC WEB BY COATING

[75] Inventors: Paul Plusquellec; Jacques Verhulst; Jean-Luc Perillon, all of Saint Paul Troix Chateaux, France

[73] Assignee: Gerflor SA, Villeurbanne, France

[21] Appl. No.: 08/845,197

[22] Filed: Apr. 21, 1997

[30] Foreign Application Priority Data

Apr. 26, 1996 [FR] France ..... 96 05522

[51] Int. Cl.[6] ..... B05D 1/36

[52] U.S. Cl. ..... 427/195; 427/202; 427/385.5

[58] Field of Search ..... 427/195, 202, 427/385.5

[56] References Cited

U.S. PATENT DOCUMENTS 3,682,741 8/1972 Elliott et al. .

4,794,020 12/1988 Lussi et al. ..... 427/195

FOREIGN PATENT DOCUMENTS

A-0 252 430 1/1988 European Pat. Off. .
A-1 033 923 6/1966 United Kingdom .
A-1 569 943 6/1980 United Kingdom .
WO-A-87 01972 4/1987 WIPO .

*Primary Examiner*—Christopher Raimund
*Attorney, Agent, or Firm*—Oliff & Berridge, PLC

[57] ABSTRACT

Disclosed is a process for the manufacture, by coating, of a plastic web. A plastisol is deposited as a layer onto a flat support, to obtain a coating layer in the pasty state. Before the plastisol is gelled, powdering is performed by accelerating particles of plastic powder toward, the external surface of the coating layer. The powder includes particles of a thermoplastic material capable of at least partially being integrated into or dissolving in the plastisol. The particles are homogeneously incorporated in order to form a single matrix with the thermoplastic base material of the plastisol.

15 Claims, 2 Drawing Sheets

PROCESS FOR THE MANUFACTURE OF A PLASTIC WEB BY COATING

BACKGROUND OF THE INVENTION

The present invention relates to the manufacture, by coating, of a relatively thin plastic web generally including at least one coating layer, itself comprising a substrate made up of at least one thermoplastic base material, especially a chlorine-containing polymer or copolymer, for example polyvinyl chloride. The coating layer optionally forms the only layer of the plastic web; it may be associated with or bound to any appropriate support, for example a nonwoven of inorganic, for example glass, fibers. Such plastic webs can be employed as floor or wall coverings, as tarpaulins or else as furniture- or motor vehicle coverings.

The present invention will now be introduced, defined, described and discussed with reference to floor or wall coverings obtained in the form of rolls or tiles from a plastic web as described above.

As is known, such coverings include one or more layers obtained by calendering or coating and themselves comprising multiple or varied decorations onto which can be optionally applied a protective layer called a wear layer, the latter contributing mechanical strength and physicochemical resistance to the coverings. These same coverings may also exhibit a relief effect, optionally corresponding to the decoration and obtained mechanically or chemically, for example by inhibition of a foaming of the substrate with one or more coating layers.

In the description which follows and the claims the following expressions carry the meanings given below:

"coating layer" is a layer obtained by applying onto a support a thin layer of material in fluid form, called a plastisol, the plastisol being a dispersion of fine particles of polymer in a liquid mixture of one or more plasticizers; a simple raising of temperature changes the coating layer from the fluid state into the solid state; this is gelling;

"calendered layer" is a layer obtained on an already gelled solid mixture of plastic heated by forced passes between two or more hot rolls.

In general, to obtain by coating a covering which can be considered similar to at least one plastic web, at least the following stages are linked into a sequence:

a) a plastisol is placed or obtained in the pasty state, that is to say in a relatively liquid or semiliquid state, including the plastic substrate in divided form and a plasticizing agent;

b) the plastisol is deposited as a layer onto a flat support to obtain the coating layer in the pasty state;

c) the plastisol is gelled to obtain the coating layer in the solid state, but relatively plastic;

d) optionally, after the gelling state c), the coating layer is grained or goffered.

It is known in various documents, for example Patent Applications EP-A-0 252 430, GB-A-1 033 923, GB-A-1 569 943, U.S. Pat. No. 3,682,741 and WO-A-87/01972, to incorporate plastic-based particles used to create a decorative effect in the coating layer, for example by encapsulation (EP-A-0 252 430) or else by sedimentation (U.S. Pat. No. 3,682,741).

The process generally used in these documents is a process for the manufacture of a plastic web including at least one coating layer comprising a substrate made up of at least one thermoplastic base material, especially a chlorine-containing polymer or copolymer, for example polyvinyl chloride, said process including at least the following stages:

(a) a plastisol is arranged in the pasty state, including the substrate in divided form and a plasticizing agent;

(b) the plastisol is deposited as a layer onto a flat support to obtain the coating layer in the pasty state;

(c) the plastisol is gelled to obtain said coating layer in the solid state but plastic; and between the stage (b) of formation of the coating layer and the stage (c) of gelling of the plastisol, at least one stage of powdering is performed, according to which particles of plastic powder are accelerated merely by gravity toward the external surface of the coating layer in the pasty state, and the particles thus accelerated are distributed according to the external surface of said coating layer.

The process described above consequently requires the use of a plastisol in the pasty state, made up traditionally of the thermoplastic base material, for example polyvinyl chloride, in divided or discrete form, dispersed in a plasticizing agent in liquid form.

However, the use of plastisols of this type does not remain problem-free, because it requires the use of a large quantity of plasticizers, for example a proportion of plasticizer of between 55 to 65 per cent by weight of the quantity of base plastic, to obtain a viscosity which is acceptable for the coating tools, such as doctor blades and to allow good deaeration of the coating layer(s) formed. The plasticizers most commonly employed are organic derivatives of acids such as phthalic acid, phosphoric acid, benzoic acid, adipic acid, citric acid, glutaric acid, lauric acid, sebacic acid, azelaic acid, capric acid and trimellitic acid. On the other hand, this large quantity of plasticizers does not make it possible to obtain a coating exhibiting acceptable surface properties once the layers are gelled, and the coating exhibits in particular a stain resistance and soiling by pedestrian traffic which rule it out, a greasy and adhesive feel, an unpleasant odor, excessive flexibility and an exaggerated and permanent tendency to exudation.

In order to overcome these disadvantages the manufacturers of coverings often add plastifiers to replace a proportion of the plasticizers, and this also makes it possible to obtain viscosities which are lower than with plasticizers alone, the low viscosities being desired to allow coating at high speed and therefore economically advantageous. These are generally low-viscosity organic liquids, for example petroleum cuts with a boiling range of between 130° C. and 320° C., or products such as dodecylbenzene and texanol isobutyrate. The coating layer formulations, for example PVC-based, may contain plastifiers in a proportion of 5 to 20 per cent by weight of the quantity of base plastic, and this allows the proportion of plasticizer in the formulation to be lowered to approximately 40 to 50 per cent by weight of the quantity of base plastic. The feel and the stain resistance thus become acceptable.

Despite this advantage, the use of plastifiers creates another problem, namely in that they give rise to large volumes of volatile organic components (VOC). In particular, the use of plastifiers does not make it possible to meet the new requirements relating to air quality. Volatilization of these components on industrial sites, for example during the gelling of the plastic layers, is unavoidable and requires costly plant for the condensation and trapping of the effluents. Furthermore, even after gelling, the coating comprising plastifiers continues to give off VOCs by evaporation throughout its use, and this is reflected in odor problems and headaches in places where these products are installed. New European legislations will set a maximum quantity for the release of these VOCs and the plastifiers currently employed are aimed at in particular.

It is also important to stress that the use of plastifiers does not make it possible to reduce the quantity of plasticizers below a certain proportion.

To avoid employing plastifiers, and in coating technology, it might be assumed that it would be sufficient quite simply to increase the quantity of plasticizer in the base plastisol, as overplasticizer, in order to keep a viscosity which is compatible with processability on production equipment. This solution unfortunately gives a final product in the form of a web which is adhesive and unsuitable in particular for use as floor covering.

SUMMARY OF THE INVENTION

The Applicant has found that, in coating, the solution to this twofold problem is to overplasticize the plastisol to form the coating layer and then to reduce the proportion of plasticizer to a ratio which is normal, or even lower than the normal, by the addition and homogeneous incorporation of PVC into the coated layer, before finishing of the product, that is to say before gelling, this being done while avoiding practically any use of plastifier.

The main subject matter of the present invention is therefore a process for the manufacture of a plastic web, and especially of a floor covering, which makes it possible to eliminate practically all plastifier and to limit the proportion of plasticizer, this being without modifying the coating techniques and tools.

Consequently, the subject matter of the invention relates to a process according to the general scheme given above, in which more particularly, the plastic powder includes particles of at least one thermoplastic material for incorporation, capable of at least partially being integrated into or dissolving in the substrate of the plastisol, especially a thermoplastic material of a chemical nature which is identical with or similar to that of the thermoplastic base material;

the acceleration is voluntary and the voluntary acceleration and the distribution are performed in such a way that the particles are incorporated homogeneously in at least one, top and/or back, surface layer of the coating layer.

The plastic powder including particles of at least one thermoplastic material for incorporation are preferably completely and homogeneously integrated into the macromolecular matrix of the substrate of the coating layer.

The expression "voluntary acceleration" as employed in the description and the claims is intended to mean an acceleration of the particles which is greater than the acceleration due to the effect of gravity.

Another subject matter of the present invention is a plant for the manufacture, by coating, of a plastic web including at least one coating layer comprising a substrate made up of at least one thermoplastic base material, said plant including:

(A) a source of a plastisol in the pasty state including the substrate in divided form and a plasticizing agent;

(B) a station for depositing the plastisol as a layer onto a flat support, to obtain the coating layer in the pasty state;

(C) a station for gelling the plastisol, to obtain said coating layer in the solid state but plastic;

and between the station (B) for depositing the coating layer and the station (C) for gelling the plastisol, a station for powdering is placed.

A more particular feature of the plant is that the powdering station includes:

a source of a plastic powder including particles of at least one thermoplastic material for incorporation;

means for accelerating the particles of the powder toward the external surface of the coating layer in the pasty state and for distributing the particles thus accelerated according to the external surface of said coating layer, which are arranged and controlled in order to homogeneously incorporate the distributed and accelerated particles in at least one surface layer of the coating layer.

Another subject matter of the present invention is a plastic web including at least one coating layer comprising a substrate made up of at least one thermoplastic base material, especially a chlorine-containing polymer or copolymer, for example polyvinyl chloride, in which the particles for incorporation form a single matrix with the thermoplastic base material in at least one surface layer of the coating layer, and the latter comprises practically no plastifying agent consisting of at least one volatile organic compound which has a vapor pressure of at least 0.1 Pa at 20° C.

According to the invention the particles must form a homogeneous matrix which is integrated with the thermoplastic base material, if possible as soon as they are incorporated into the plastisol, and at least into a surface layer of the coating layer, and in any event after gelling. It follows that there is no sedimentation of the particles, nor encapsulation of the latter in the matrix of the coating layer, as is the case with the documents of the prior art which were discussed above.

The weight and overall percentage of the plasticizing agent is advantageously at least 20 phr, that is to say 20 parts per 100 of the thermoplastic base material of the substrate of the coating layer.

Finally, another subject matter of the present invention is a floor or wall covering obtained in the form of rolls or tiles from a plastic web in accordance with the invention.

In accordance with the present invention it has been discovered in particular that the incorporation, at least at the surface, or even throughout, of a plastic powder including particles of at least one thermoplastic material capable of being integrated or of dissolving at least partially, or even completely and homogeneously in the macromolecular matrix of the substrate of the plastisol, in a manner of speaking plastifies the coating layer without otherwise considerably modifying its other physicomechanical properties. This surprising discovery has allowed the Applicant to reduce the overall quantity of plasticizers in the coating layer below approximately 30 parts per hundred of the thermoplastic base material of the coating layer.

Furthermore, when employed as, or for forming, floor or wall coverings, the plastic webs including this essentially plastifier-free coating layer offer better performance than floor coverings manufactured by calendering.

In addition, since the process according to the present invention makes it possible to avoid the use of plastifiers, it becomes possible to meet the requirements relating to air quality and, at the same time, to maintain, or even improve, the behavior of the coverings or webs manufactured according to the process, and especially to improve their feel, their resistance to staining, to soiling and to wear, and their flexibility or stiffness.

With the process according to the present invention it is also possible to employ recovered, that is to say recycled, ground PVC particles without being obliged to mix them with another polymer in powder form compatible with PVC, such as, for example, ethylene/vinyl acetate (EVA). Hitherto this was not possible with the conventional coating processes.

The Applicant has also discovered that according to the process of the invention it is possible to have a weight proportion of particles for incorporation which are integrated into the plastisol of between approximately 20% and approximately 60% by weight relative to the weight of the thermoplastic base material present in the initial plastisol. This is approximately equivalent to a weight proportion of integrated particles of between approximately 20% and approximately 50% by weight relative to the total weight of the coating layer.

According to a preferred embodiment of the process of the invention the plastic powder to be incorporated has a particle size of between 2 $\mu$m and 500 $\mu$m and preferably between 20 $\mu$m and 100 $\mu$m.

During the powdering stage the accelerated particles are advantageously distributed according to a density per unit area of between 30 g/m$^2$ and 500 g/m$^2$ and preferably between 50 g/m$^2$ and 300 g/m$^2$.

More preferably, during the powdering stage the viscosity of the coating layer in the pasty state is adjusted to a value lower than 5 Pa s and preferably to a value of the order of 1 Pa s.

In a still more preferred alternative form of the process according to the invention the powdering stage is repeated at least once.

After the gelling stage (c) the coating layer is preferably grained.

In an alternative form of preferred embodiment of the plant according to the present invention the means for accelerating and distributing the plastic powder for incorporation include any one of the following items of hardware, namely hardware for spraying by an electrostatic or triboelectric route, hardware with a dispersing machine and hardware with a spraying turbine.

The means for accelerating and distributing the plastic powder for incorporation preferably include an item of hardware for spraying by an electrostatic route, with means for interposing the coating layer in the pasty state between at least one nozzle for ejecting the plastic powder and the support of metallic nature forming a target, itself grounded. In fact, it has been found that when employing electrostatic spraying this makes is possible, on the one hand, to increase, in a surprising manner, the quantity of powder which can be absorbed by the plastisol and, on the other hand, to improve the entry of the powder into the plastisol.

According to a still more preferred embodiment of the invention the plant is adjusted to charge the plastic powder for incorporation negatively between 5 kV and 70 kV and preferably between 30 kV and 50 kV.

In a preferred embodiment of the plastic web according to the invention the weight percentage of the plasticizing agent is at most 100 phr and preferably between 70 phr and 40 phr, more preferably between approximately 30 and approximately 40 phr.

The plastic material for incorporation advantageously includes particles of a chlorine-containing polymer or copolymer, for example of polyvinyl chloride, advantageously recovered and ground beforehand.

The plastic material for incorporation is preferably a chlorine-containing polymer or copolymer chosen especially from PVC homopolymers, copolymers of vinyl chloride and of vinyl acetochloride and graft copolymers.

The plastic material for incorporation more preferably has a K value of between 45 and 110.

In a preferred alternative form of embodiment the web includes a flat support of the coating layer, for example a nonwoven of inorganic fibers.

The subject matters of the present invention and the advantages which they provide, will be understood better with the aid of the following detailed description, given without any limitation being implied, and of the appended drawings, in which:

BRIEF DESCRIPTION OF THE DRAWINGS

FIG. 1 shows a diagrammatic view in section along a plant 1 or line for the manufacture of a floor covering in accordance with the invention. This plant comprises a source 2 of a plastisol 3 in the pasty state, including a substrate in divided form and a plasticizing agent. The substrate is made up of at least one thermoplastic base material, for example PVC. The vinyl plastisols as employed in the present invention are generally dispersions of fine particles of vinyl polymers in one or several liquid plasticizers. The coated plastisol 3 may also contain adjuvants and various additives capable, for example, of migrating, in an added powder, which will be explained below.

Figure 1:
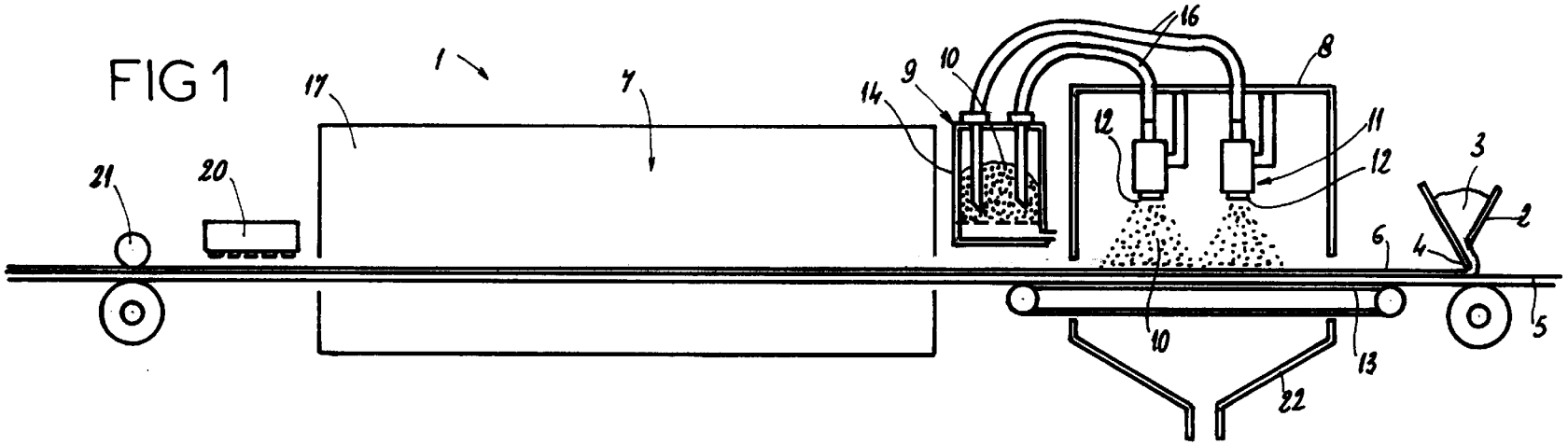
FIG. 1 shows a diagrammatic view of a plant or line for the manufacture of a floor covering according to a preferred embodiment of the invention.

The plasticizing agent referred to above may be a plasticizer or a mixture of plasticizers which are generally known and is preferably chosen from the group consisting of the organic derivatives of acids such as phthalic acid, phosphoric acid, benzoic acid, adipic acid, citric acid, glutaric acid, lauric acid, sebacic acid, azelaic acid, capric acid, trimellitic acid or a mixture of one or more of these compounds. More preferably still the plasticizer is chosen from the group consisting of diethylhexyl phthalate, butyl benzyl phthalate, alkyl benzyl phthalate, diisoheptyl phthalate, diisooctyl phthalate, diisononyl phthalate, diphenyl octyl phosphate, isodecyl diphenyl phosphate, alkyl benzyl phosphate, tri-2-ethylhexyl phosphate, tricresyl phosphate, diethylene glycol dibenzoate, dipropylene glycol dibenzoate, polyethylene glycol dibenzoate, isodecyl benzoate, glyceryl tribenzoate, diethylhexyl adipate, diisononyl adipate, tridecyl adipate, didecyl adipate, triethyl citrate, tributyl citrate, acetyl tributyl citrate, trimellitates, chlorinated waxes, polyesters and epoxy derivatives, or a mixture of at least two of these.

According to the present invention the plastifiers are essentially replaced with plasticizers, which means that the starting plastisol is therefore overplasticized and contains practically no plastifier, and preferably is totally free from plastifier. The excess plasticizer is totally absorbed by a plastic powder for incorporation, which is dusted onto the pasty coated plastisol. The final proportion of plasticizer is determined by the weight of plastic powder for incorporation which is deposited.

The source 2 of plastisol 3 may be a hopper containing it, used in combination with a station for depositing 4, for example a doctor blade, the plastisol 3 as a layer onto a flat support 5, to obtain a coating layer 6 in the pasty state. The flat support 5 allows the coating layer in the pasty state to be supported and may be, for example, a release paper of known type, a non-woven of inorganic fibers or a metallic or nonmetallic nonadhesive endless belt.

Further downstream of the source 2 and of the depositing station 4 there is a gelling station 7 the details of which will be given later, but which serves essentially for obtaining said coating layer 6 in the solid state but plastic.

Between the depositing station 4 and the station for gelling 7 the plastisol 3 there is a powdering station 8. This powdering station, which is shown diagrammatically on an enlarged scale in FIG. 3, includes a source 9 of a plastic powder 10 including particles of at least one thermoplastic material for incorporation and means for accelerating 11 the particles of the powder 10 toward the external surface of the coating layer 6 in the pasty state and for distributing the particles thus accelerated according to the external surface of said coating layer. The means for accelerating and distributing 11 are arranged and controlled in order to incorporate homogeneously the distributed and accelerated particles at least in a surface layer of the coating layer.

The means for accelerating 11 and distributing the plastic powder 10 for incorporation include any one of the following items of hardware, namely hardware for spraying by an electrostatic or triboelectric route, hardware with a dispersing machine and hardware with a spraying turbine. Suitable machines can be obtained, for example, from the Saladin, Caratsch, Knobel and Schilling companies, a spraying turbine from the Pillon company, an electrostatic sprayer from the Sames company and a triboelectric sprayer from the Ransburg-Gema company.

Figure 3:
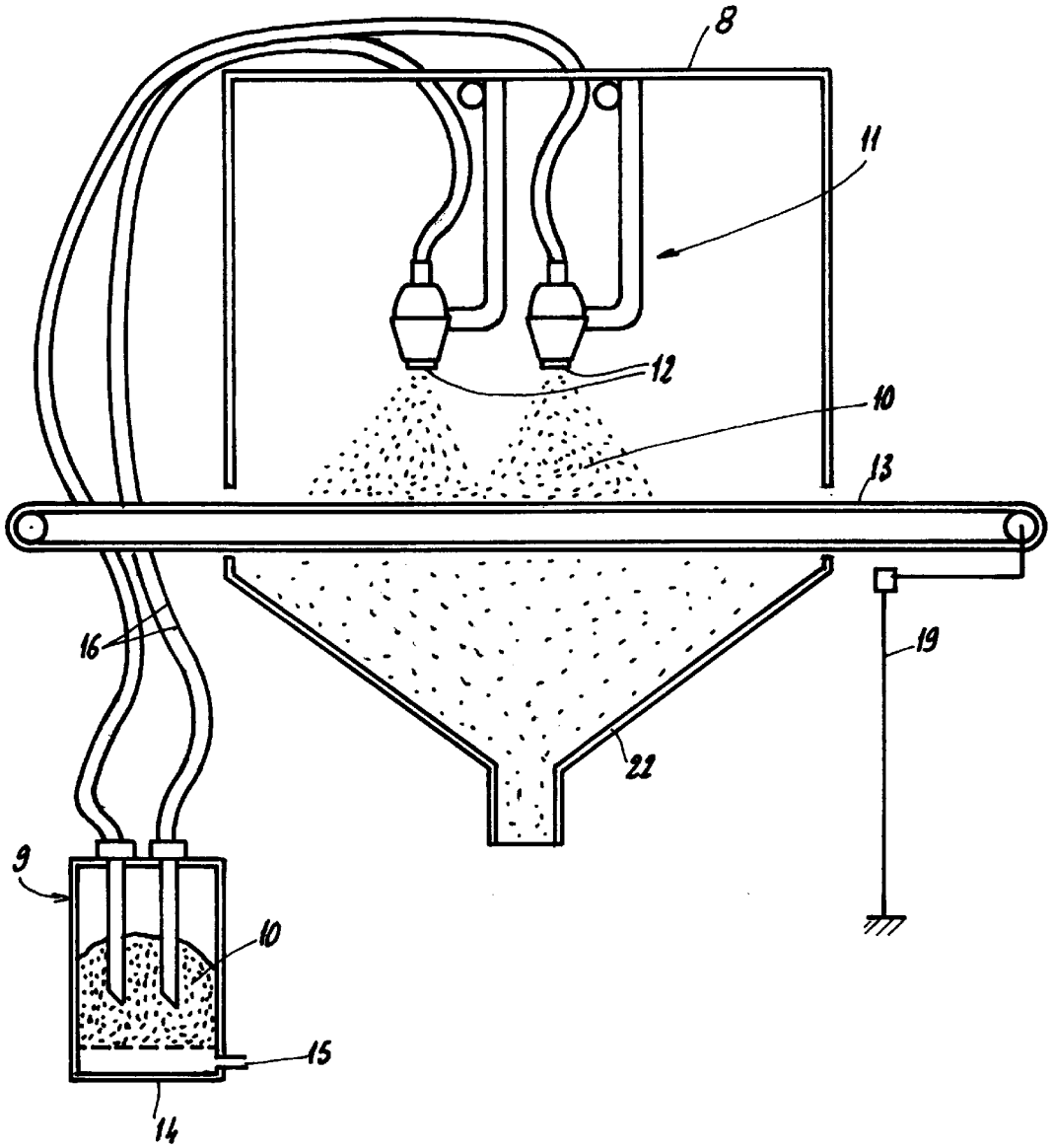
FIG. 3 shows a diagrammatic view on an enlarged scale of a station for powdering by acceleration of particles, shown in FIGS. 1 and 2 and according to a preferred alternative form of the invention.

In FIG. 3 the means for accelerating 11 and distributing the plastic powder 10 for incorporation include hardware for spraying by an electrostatic route, with means for interposing the coating layer (not shown) in the pasty state between at least one nozzle for ejecting 12 the plastic powder 10 and the support 13 of metallic nature forming a target. This support 13 is, for example, a metallic conveyor belt which is grounded 19. The source 9 of plastic powder 10 for incorporation may consist of a storage tank 14 connected to the ejection nozzles 12 by feed conduits 16 for plastic powder for incorporation 10, and a feed entry 15 for the recovered particles, as described below.

The plant 1 is controlled at a central control unit (not shown) or one for each treatment station, with the result that the powdering station 8 charges the plastic powder 10 for incorporation negatively between 5 kV and 70 kV and preferably between 30 kV and 50 kV.

Since there is a difference in potential or in electrical polarity between the powder particles 10 and the metallic belt 13, said particles are accelerated toward the belt 13 and enter and are incorporated and integrated homogeneously, at least in one top and/or back surface layer, in the macromolecular matrix of the substrate of the coating layer 6. During the incorporation of the particles into the coating layer they melt and are completely integrated into the network or the macromolecular matrix of the substrate, with the result that they absorb the plasticizers and the stabilizers of the coating layer and intimately mix with the latter, thus forming a single matrix. In the case where the thermoplastic base material of the substrate of the coating layer and the integrated particles are of identical or virtually identical nature it is impossible or practically impossible to distinguish the particles of the thermoplastic base material, except to determine the percentage of plastifiers in the composition of the coating layer by means, for example, of the FLEC test, which will be described later, and which shows that the coating layer according to the invention comprises practically no plastifiers, or even none at all. The particles of powder for incorporation 10 which are in excess and do not reach the coating layer are collected in a collector 22 and conveyed back toward the feed entry 15 of the storage tank 14.

Insofar as the particles of powder 10 for incorporation are concerned, these preferably have a mean particle size of between 20 and 50 microns.

The particles of plastic powder 10 which are employed are preferably PVC particles. PVC is intended to mean both polymers whose K values are preferably between 45 and 110, for example homopolymers of K value of between 55 and 110, and copolymers of vinyl chloride and of vinyl acetochloride or graft copolymers of K value of between 45 and 100. The term K value is well known to a person skilled in the art in this field and does not require further details.

The term PVC can also be applied to PVC scrap or compositions based on PVC or PVC copolymers.

For example, to obtain low-deposition layers, for example with a density per unit area of approximately 30 g/m$^2$, it is preferable to employ extender PVC homopolymers or copolymers (also called cutting resins). On the other hand, PVC homopolymers or copolymers of suspension, or bulk, type are employed in the case of a deposition of high density per unit area (of the order of 300 g/m$^2$). Emulsion and microsuspension PVCs can also be employed with or without anticaking treatment to obtain silky effects.

These various PVC homopolymers or copolymers can also be employed as a mixture with a single powdering or with two successive powderings, in order to obtain various, for example surface or decorative, effects. In particular, the powdering stage may be performed with a plastic powder containing additives in powder form, and this also makes it possible to modify the surface properties of the PVC plastisols. Such additives are in particular waxes, matting agents, slip agents, various fillers such as calcium carbonate, talc, dolomite, silica and a variety of oxides.

An important advantage of the process and of the plant according to the invention is that the powdering makes it possible to obtain highly filled formulations. This is not possible by conventional coating unless large quantities of plasticizer and of plastifier are employed, giving products which are too flexible, containing a lot of residual VOCs.

Once the powdering has been performed, the coating layer 6 and the incorporated and integrated particles of plastic powder 10, as well as the support 5, are conveyed toward a gelling station 7. This gelling station 7 includes, for example, a direct or indirect hot air oven 17 or infrared lamps (not shown). At this stage the coating layer is no longer in the pasty state but is still plastic.

Figure 2:
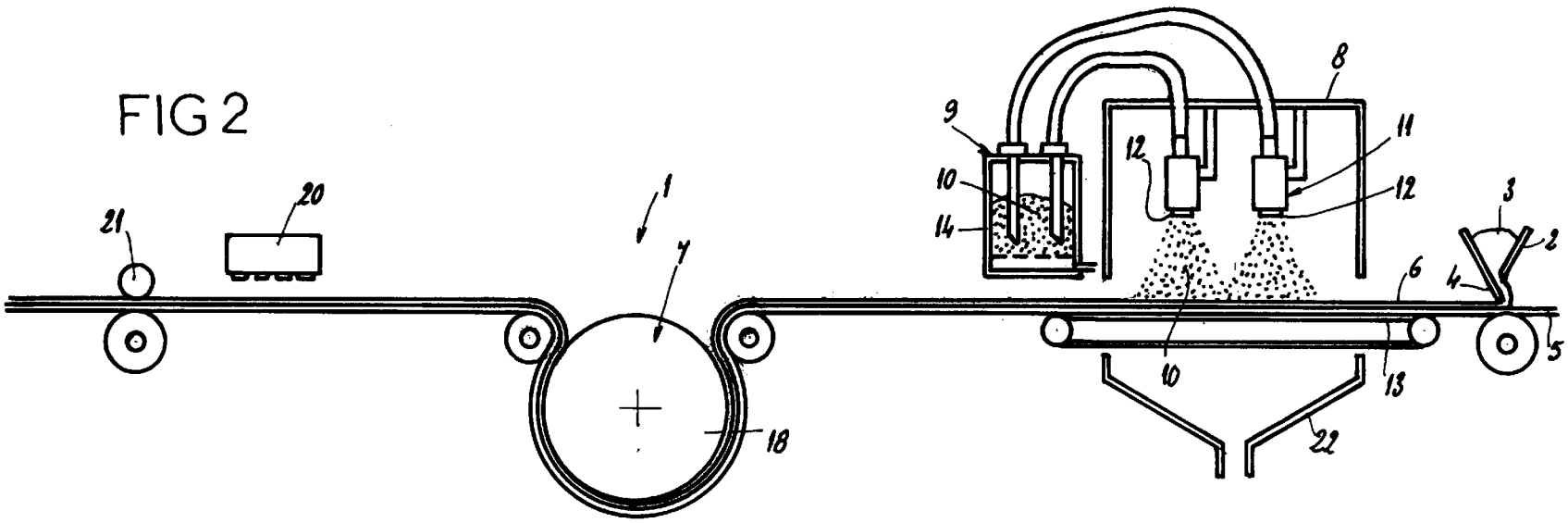
FIG. 2 shows a diagrammatic view of a plant or line for the manufacture of a floor covering according to another preferred embodiment of the invention.

If the quantity of material dusted on is very large or if the apparent density of the material to be powdered is very small (fine particle size), its integration throughout the overplasticized cool plastisol can be facilitated by gelling on a gelling station 7 comprising a heated drum 18. This alternative form is shown by FIG. 2, in which the same reference numbers apply to the same components of the plant 1. In this way it is easy to obtain filling layers which are highly filled, not highly plasticized and which contain no plastifier.

After the gelling stage the coating layer incorporating the plastic powder homogeneously in the macromolecular matrix, and optionally other additives or fillers in powder form, moves to optional stations for curing 20, for example infrared lamps, and for graining 21 if this is desired.

Another advantage of the present invention is the possibility of recycling scrap PVC and its copolymers, which is generally very easy in calendering. On the other hand, in coating, in order to reuse ground PVC scrap, it is necessary to mix it with another polymer in powder form which is compatible with PVC, such as ethylene/vinyl acetate. The combined action of heating and of pressure (for example infrared and then compacting) makes it possible to agglomerate the PVC scrap with the melting polymer matrix. This process is costly because the melting resins in powder form (EVA or other) are much dearer than PVC scrap.

With the process for powdering onto pasty plastisol and the plant in accordance with the present invention the overplasticized pasty plastisol can absorb very large quantities of PVC scrap and thereby contribute additional plasticization to the PVC scrap. Conversely, the final plastisol layer and excessively plasticized PVC scrap can be deplasticized by the addition, in the scrap, of extender or suspension PVC which will absorb a certain quantity of plasticizer in order to be plasticized itself.

The present invention will now be illustrated by a few examples of floor coverings manufactured according to the process of the invention described above.

EXAMPLES

Comparative Example No. 1

Comparative Example No. 1 relates to a standard transparent surface formulation:

| | |
|---|---|
| Emulsion PVC (K 80) | 35 |
| Microsuspension PVC (K 70) | 35 |
| Extender PVC (K 65) | 30 |
| Butyl benzyl phthalate | 30 |
| Dioctyl phthalate | 10 |
| Barium-zinc stabilizer | 4 |
| Epoxy stabilizer | 4 |
| UV stabilizer | 0.2 |
| Plastifier | 10 |

This plastisol contains 10 phr (per hundred of PVC resin) of plastifier to lower the viscosity.

Example According to the Invention No. 1

This example relates to a transparent surface formulation without plastifier and with low plasticization:

| | |
|---|---|
| Emulsion PVC (K 80) | 45 |
| Microsuspension PVC (K 70) | 45 |
| Extender PVC (K 65) | 10 |
| Butyl benzyl phthalate | 40 |
| Dioctyl phthalate | 10 |
| Barium-zinc stabilizer | 5.7 |
| Epoxy stabilizer | 5.7 |
| UV stabilizer | 0.3 |
| Plastifier | zero |

The starting point is a formulation which is slightly more plasticized containing no plastifier at all.

To obtain a deposition of 350 g/m$^2$ density per unit area to prepare a surface layer, 275 g/m$^2$ of this plastisol are coated and 75 g/m$^2$ of an extender PVC are dusted on (275 g+75 g=350 g).

The final plasticization is thus brought to 34.7 phr. The extender PVC dusted on has absorbed the excess plasticization and stabilization and the surface layer contains no plastifier.

The rate and temperature of gelling are the same as for the comparative surface No. 1.

Example According to the Invention No. 1 bis:

If the intention is to further lower the plasticization of the surface layer, the quantity of PVC dusted on must be increased; in this case it is also appropriate to increase the quantity of stabilizer.

Starting with the above formulation, containing 6.6 phr of barium-zinc stabilizer and 6.6 phr of epoxy stabilizer, a surface layer is obtained with a final plasticization of 30 phr if 100 g/m$^2$ of extender PVC are dusted onto 250 g/m$^2$ of this plastisol.

The comparison of the properties of these surfaces is summarized in Table I which follows:

TABLE I

| Volatile contents compared: | Comparative Example No. 1 | Example No. 1 | Example No. 1 bis |
|---|---|---|---|
| In the starting plastisol | 10 phr | 0 | 0 |
| During the gelling (loss in oven) | 7 to 8 phr (70 to 80%) | 0 | 0 |
| In the final product | 300 to 500 $\mu$g/m$^2$/h | <50 $\mu$g/m$^2$/h | <50 $\mu$g/m$^2$/h |
| Nord method FLEC* test | | | |
| Characteristics: | | | |
| Staining resistance | Mediocre | Good | Very good |
| Flexibility | Flexible | Firm | Firm |
| Handle | Plastic | Tiling | Tiling |
| Soiling | Mediocre | Very good | Very good |
| Odor (according to plastifier) | Strong to very strong | Very faint | Very faint |

*FLEC = Field and laboratory emission cell

The Nord FLEC test method employs the FLEC as a sampling chamber. This chamber is a circular sampling cell made of electropolished steel, 35 ml in volume and allows an area of 0.0177 m$^2$ to be analyzed. The method allows emissions of volatile organic compounds originating from the surface of the floor coverings to be quantified. The samples are subjected to flushing with air of controlled quality and flow rate (temperature of 23° C.±2° C., relative humidity of 45%±5%, at 100 ml/minute). The air is distributed over the perimeter of the cell and leaves via its center, the air outflow being split into three to make two samples and a normal outflow to free air. The floor covering sample is taken as soon as it is manufactured, rolled up over itself with the wear surface outward, wrapped in aluminum, and the whole is placed in a polyethylene bag which is heat-sealed. After 4 weeks the sample is opened and 2 squares of 20 cm side are cut from it. The squares are then stored at 23° C. for 4 weeks and the first analysis is performed at the end of this period. The analysis instruments include a gas chromatography apparatus with a mass detector coupled to a thermal desorber. The total concentration of volatile organic components, expressed in $\mu$g/m$^2$, which is subsequently converted into $\mu g*m^{-2}*h^{-1}$ is obtained by introducing the parameters of the sampling chamber.

Comparative Example No. 2

This comparative example relates to a plastisol formulation for filled coating:

| | |
|---|---|
| Emulsion PVC (K 80) | 30 |
| Emulsion PVC (K 70) | 70 |
| Dioctyl phthalate | 70 |
| Barium-zinc stabilizer | 2 |
| Titanium dioxide | 2 |
| Calcium carbonate | 100 |
| Plastifier | 4 |

Example According to the Invention No. 2

This example relates to the possibility of recovering in the form of coating previously micronized PVC or PVA scrap.

According to the average K value of the scrap to be recycled, the ratio of the K values of the emulsion PVCs will be adjusted; this allows the average K value of the final formulation not to be lowered too much. With micronized scrap of calendered slabs of an average K value of 60 the following formulation can be employed:

| | |
|---|---|
| Emulsion PVC (K 80) | 80 |
| Emulsion PVC (K 70) | 20 |
| Dioctyl phthalate | 70 |
| Barium-zinc stabilizer | 2 |
| Titanium dioxide | 1 |
| Calcium carbonate | 60 |
| Plastifier | zero |

400 g/m$^2$ of this plastisol are coated and 200 g/m$^2$ of micronized scrap are dusted on. The whole is then gelled on a heated drum at the same rates and temperatures as comparative formulation No. 2.

We claim:

1. A process for the manufacture, by coating, of a plastic web including at least one coating layer comprising a substrate made up of at least one thermoplastic base material, the process comprising the following stages:

(a) obtaining a plastisol in a pasty state, said plastisol comprising the substrate in divided form and a plasticizing agent;

(b) depositing the plastisol as a layer onto a flat support to obtain a coating layer in a pasty state;

(c) powdering the coating layer in the pasty state by distributing and voluntarily accelerating toward the external surface of the coating layer particles of at least one thermoplastic material, so that said particles are incorporated homogeneously in at least one, top or back, surface layer of said coating layer;

(d) gelling the coating layer with the incorporated particles to obtain the coating layer in a solid state, said particles of said at least one thermoplastic material being capable after their incorporation according to stage c) of at least partially being integrated into or dissolving in the substrate of the plastisol at the end of this gelling stage; and wherein during stage a) the plastisol is overplasticized whereas during stage c) the plastisol is deplasticized by the incorporation of the at least one thermoplastic material, whereby the overall quantity of the plasticizing agent in the gelled coating layer remains below about 30 phr of the thermoplastic base material.

2. The process as claimed in claim 1, wherein the particles is completely and homogeneously integrated into the macromolecular matrix of the substrate of the coating layer.

3. The process as claimed in claim 1, wherein the particles to be incorporated has a particle size of between 2 $\mu$m and 500 $\mu$m.

4. The process as claimed in claim 1, wherein during the powdering stage the accelerated particles are distributed in a density per unit area of between 30 g/m$^2$ *and* 500 g/m$^2$.

5. The process as claimed in claim 1, wherein during the powdering stage the viscosity of the coating layer in the pasty state is adjusted to a value lower than 5 Pa s.

6. The process as claimed in claim 1, wherein the powdering stage is repeated at least once.

7. The process as claimed in claim 1, wherein after gelling stage the coating layer is grained.

8. The process as claimed in claim 1, wherein the thermoplastic base material is a chlorine-containing polymer or copolymer.

9. The process as claimed in claim 8, wherein said chlorine-containing polymer or copolymer is polyvinyl chloride.

10. The process as claimed in claim 1, wherein said at least one thermoplastic material is a thermoplastic material of chemical nature which is identical to that of the thermoplastic base material.

11. The process as claimed in claim 3, wherein the particles have a particle size between 20 micrometers and 100 micrometers.

12. The process as claimed in claim 4, wherein the accelerated particles are distributed in a density per unit area of between 50 g/m$^2$ and 300 g/m$^2$.

13. The process as claimed in claim 5, wherein the viscosity of the coating layer in the pasty state is adjusted to a value of the order of 1 Pa s.

14. The process as claimed in claim 1, wherein said solid state is a plastic solid state.

15. The process as claimed in claim 1, wherein during stage c) the weight proportion of particles incorporated into the plastisol is between about 20 to 60% of the thermoplastic base material.

* * * * *